US005178732A

United States Patent [19]

Steiner et al.

[11] Patent Number: 5,178,732

[45] Date of Patent: Jan. 12, 1993

[54] PRESS SECTION OF A PAPER MACHINE WITH TWO ELASTIC PRESS ELEMENTS

[75] Inventors: Karl Steiner, Herbrechtingen; Albrecht Meinecke; Karl Gaugenmaier, both of Heidenheim, all of Fed. Rep. of Germany

[73] Assignee: J.M. Voith GmbH, Fed. Rep. of Germany

[21] Appl. No.: 745,485

[22] Filed: Aug. 15, 1991

[30] Foreign Application Priority Data

Aug. 17, 1990 [DE] Fed. Rep. of Germany ..... 4026021

[51] Int. Cl.[5] ..... D21F 3/04

[52] U.S. Cl. ..... 162/360.2; 162/358.3; 162/359.1; 162/360.3

[58] Field of Search ..... 162/358, 359, 360.1

[56] References Cited

U.S. PATENT DOCUMENTS

| | | | |
|---|---|---|---|
| 3,268,390 | 8/1966 | Ely, Sr. | 162/360.1 |
| 3,804,707 | 4/1974 | Mohr et al. | 162/358 |
| 4,059,482 | 11/1977 | Kankaanpaa et al. | 162/360.1 |
| 4,086,131 | 4/1978 | Rempel et al. | 162/360.1 |
| 4,483,745 | 11/1984 | Wicks et al. | 162/360.1 |
| 4,526,655 | 7/1985 | Karvinen et al. | 162/360.1 |
| 4,556,451 | 12/1985 | Ely | 162/360.1 |
| 4,752,519 | 6/1988 | Boyer et al. | 162/358 |

FOREIGN PATENT DOCUMENTS

| | | | |
|---|---|---|---|
| 88/08051 | 10/1988 | PCT Int'l Appl. | 162/360.1 |

*Primary Examiner*—Karen M. Hastings

*Attorney, Agent, or Firm*—Ostrolenk, Faber, Gerb & Soffen

[57] ABSTRACT

A first endless felt belt (43) which absorbs water from the belt (9) passes through a first press nip (1) and a similar second felt belt (57) passes through a second press nip (II). The arrangement is such that the web (9) is continuously in contact with at least one transport means (for instance, with one of the felt belts). In both press nips (I, II) the web (9) is in contact with an endless elastic press element (for instance, press belt or press shell) the water absorption capacity of which is less than that of the felt belts (43, 57). It is essential that two endless elastic press elements which are independent of each other, namely a first and a second press element (47, 53) are present and that the one side of the web comes into contact with the first press element (47) in the first press nip (I) and the other side of the web comes into contact with the second press element (53) in the second press nip (II). The press section has neither a stone roll nor a suction press roll.

15 Claims, 6 Drawing Sheets

Fig.10
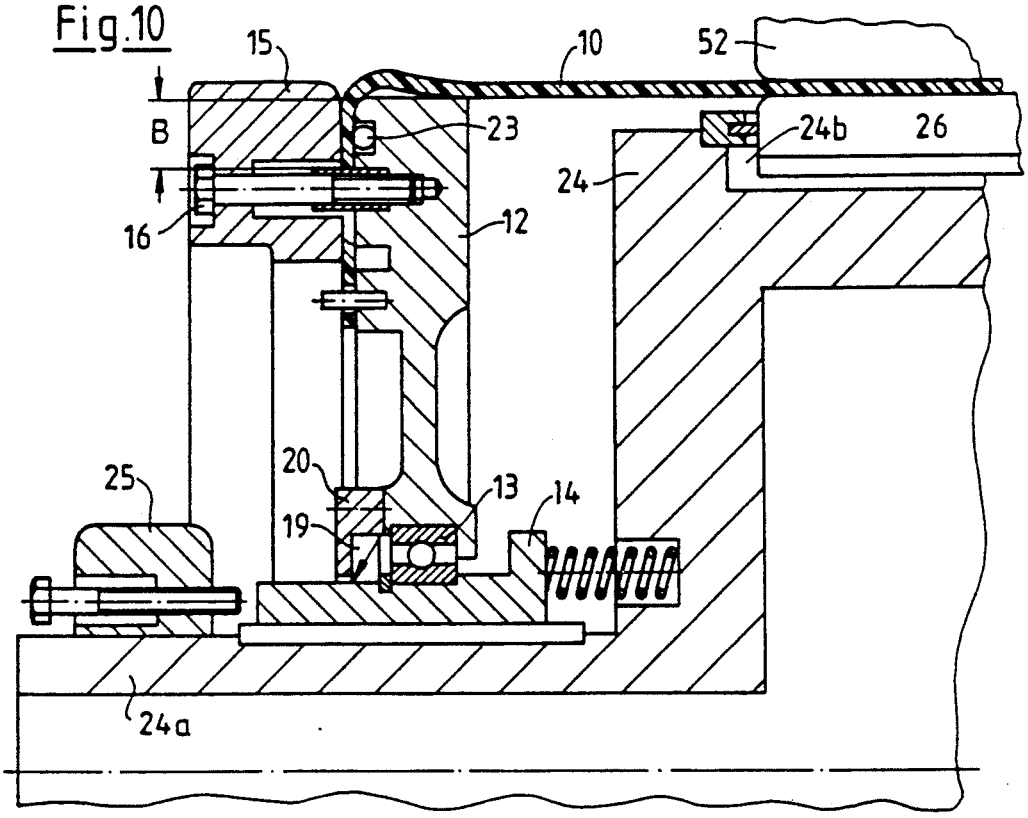
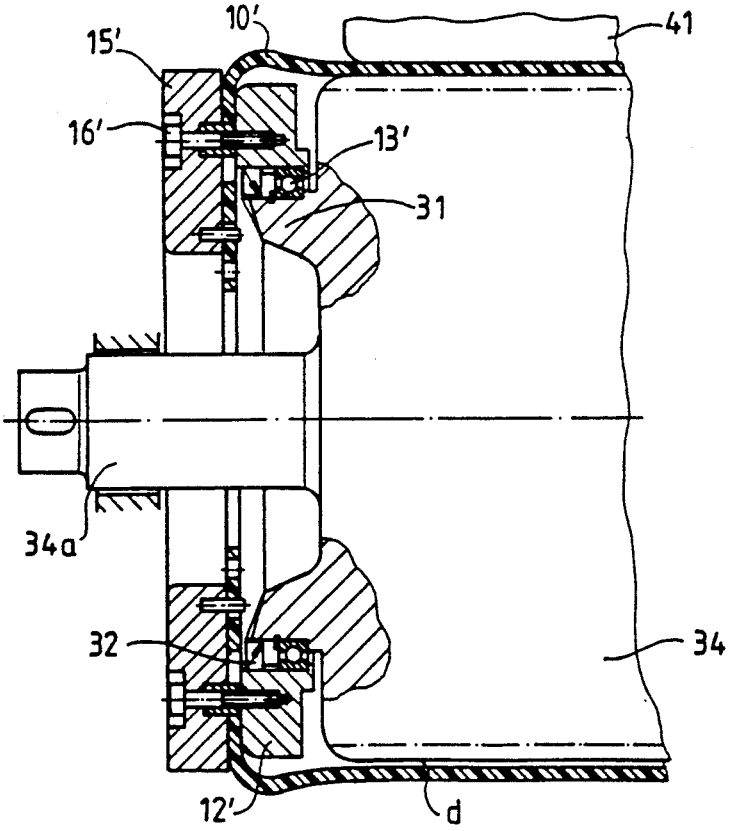
Fig.11

PRESS SECTION OF A PAPER MACHINE WITH TWO ELASTIC PRESS ELEMENTS

BACKGROUND OF THE INVENTION

The present invention relates to a press section of a paper machine for removal of water from a web, such as a paper web.

Such a press section is known from European Patent. 0 107 606 B1. In accordance with FIG. 1 of said patent, two pairs of press rolls are provided, each forming a press nip. An endless felt belt which removes water from the web, hereinafter referred to as the "water removal felt", travels through the nip. Furthermore, an endless elastic press element is present in the form of a belt which travels in succession through the two nips and over several guide rolls. The web from which the water is to be removed comes in contact with the elastic belt in the first nip and is then conducted by the belt into the second nip. By this arrangement, it is intended to achieve the result that the two water removal felts move away from the web from which the water is to be removed directly behind the two nips. Therefore, the transport of the belt behind the two nips takes place completely without participation of the two water removal felts. In this way, rewetting of the web from the water removal felts is avoided. In this way, it is attempted to increase the water removal capacity of the press section and, therefore, to obtain an increased solids content of the web when it leaves the press section.

One disadvantage of this known press section is, however, that the same side of the web is in contact with the elastic belt in both nips. Accordingly, the other side of the web is in contact with the water removal felt in both press nips. The result of this is that the final web (for instance, web of paper) has different properties on the two sides, for instance, different smoothness or absorbability.

In the development of future paper machines, it is desirable that the press section meet the following requirements:

1. The number of press nips should be as small as possible and, insofar as possible, should not exceed two in number.
2. Within each press nip the web should travel between a water removal felt and an elastic press element.
3. The use of granite or similar stone or synthetic-stone rolls should be avoided. In many cases, the use of suction press rolls should also be avoided.
4. Upon passage through the press section, the web should be in continuous contact with a transport means, for instance with a felt belt or with an elastic press element (i.e. closed path of the web without free web section).
5. The finished product as far as possible should have identical properties on its two sides.
6. The water removal capacity of the press section should be increased as much as possible over what it has been up to now; i.e. the highest possible solids content of the web when it leaves the press section should be obtained despite a very high operating speed (of the order of magnitude of 2,000 meters per minute or more).

SUMMARY OF THE INVENTION

The object of the present invention is to provide a new and improved press section that satisfies as many of the requirements indicated above as possible.

The foregoing and other objects of the invention are achieved by a press section of a paper machine which includes first and second press nips. A first endless felt belt for absorbing water from the web is arranged to travel through the first press nip and a similar second felt belt is arranged to travel through the second press nip. The arrangement is such that the web is continuously in contact with at least one of the felt belts. A first endless elastic element is disposed in the first press nip in contact with one side of the web and a second endless plastic press element is disposed in the second press nip in contact with the other side of the web.

It is essential that the two sides of the web come in contact one after the other with an elastic press element the water absorption capacity of which is substantially less than that of the water-absorbing felt belts. The elastic press elements are preferably so designed so that they have no water absorption capacity at all. In this way, rewetting of the web from the elastic press element is avoided and the two surfaces of the web are smoothed one after the other.

It is already known that the water removal capacity of a single press nip is relatively great (as compared with a double-felt press) if the web from which the water is to be removed travels through the press nip between a water-removal felt and a non-water-absorbing elastic press element. In other words, it is known that a single-felt press has a higher water-removal capacity than a double-felt press. Furthermore, it is obvious that two single-felt presses which are arranged one behind the other have a higher water-removal capacity than a single one-felt press has. Surprisingly, however, it has now been found that a further increase in the water removal capacity can be obtained in the manner that (as already mentioned) the two sides of the web come into contact with an elastic press element in both press nips and, therefore, in the manner that the one water-removal felt comes into contact with the one side of the web and the other water removal felt with the other side of the web.

This favorable result is presumably due to the following: In the known press section described above (European Patent. 0 107 606 B1), water is removed from the web twice, one after the other, from one and the same side of the web, the other side of the web being continuously in contact with the elastic belt. There is thus the danger that the surface of the other side of the web is strongly compacted so that the water-removal effect of the second press nip is reduced. Therefore, the full, theoretically possible water removal capacity of the press section is not reached. In the extreme case, there is even the danger of the web crushing.

On the other hand, with the press section in accordance with the invention, a substantially greater uniformity of the properties on both sides of the web and at the same time an unexpected increase in the water removal capacity are obtained. The press section is, therefore, suitable for extremely higher operating speeds (2,000 meters per minute or more).

In both of Federal Republic of Germany OS 37 18 462 and OS 37 29 723, press sections are described with which it is also desired to obtain greater uniformity of the two sides of the web. For this purpose, it is provided therein that the one side of the web be brought in contact with a smooth granite or similar stone or artificial-stone roll in one press nip and the other side of the web in another press nip. In that case, however, it is necessary to provide a free length of web (even though short) at the transfer place from the one smooth press roll to the other. In contradistinction to this, the present invention makes it possible to retain the known configuration without a free length of web. The use of hard press rolls, for instance stone rolls, also has still other disadvantages: On the one hand, due to the hardness of the press shell, only a relatively small amount of water can be removed. On the other hand, stone rolls result in greater expense in manufacture; furthermore, with the desired high speeds of operation, there is a greater danger of accidents since the stone roll body can unexpectedly break apart because of overstressing.

The single elastic press element can be developed, in accordance with the invention, a) either as a press belt which travels within the press nip around a press roll or over a press shoe and, furthermore, over guide rolls, b) or as a liquid-tight press shell closed at both ends, of a shoe-press unit, c) or as a liquid-tight press shell closed at both ends which travels loose over a roll body, d) or as an elastic covering of a press roll.

Press shells of the type indicated above under b) and c) are known from Federal Republic of Germany 38 05 350 (=U.S. Pat. No. 4,878,281).

It is possible for the press section of the invention to be provided with two identical or different elastic press elements and, therefore, the first press nip to be provided, for instance, with a press belt (traveling over rolls) and the second press nip with a press shell which is closed at both ends. Many variations in this respect are conceivable.

The various possible embodiments of the invention can, however, also be classified in accordance with other viewpoints, namely on the basis of the method by which the web from which the water is to be removed is transported, without a free length of web, from the first press nip to the second. In a first group of embodiments, the web is transferred from the first elastic press element directly to the second elastic press element. Thus, both elastic press elements are used as transport means. Various advantages result simultaneously from this: The construction of the entire press section is particularly simple. Furthermore, the advantage of the known configuration described above is retained, namely that upon the transport of the web from the first press nip to the second press nip rewetting of the web is completely, or almost completely, excluded.

To be sure, upon the transfer of the web from the one elastic press element to the other, certain difficulties must be overcome. Namely, on many occasions there is no assurance, without special additional measures, that the web will actually shift from the first to the second elastic press element. For example, it may happen that, in particular, the edges of the web have a tendency to continue to move along with the first elastic press element. However, various possibilities have been found for controlling said difficulties.

Many of these measures can also be used in another connection, namely in a press section in which the web travels over a traditional smooth and hard press roll (for instance, a stone roll) and is to shift from it onto an elastic press element, for instance a belt. Such a configuration is conceivable, for example, for the modernization of a traditional press section in which the web travels through a first press nip (formed by the hard press roll and a first water-removal felt) and then through a second press nip formed by an elastic press element and a second water-removal felt. In this case also, the one side of the web first comes into contact with a smooth surface (for instance of the stone roll) and then the other side of the web (by contact with the elastic press element). Similarly, the removal of the water takes place first in one direction and then in the other direction. It is conceivable, in the case described above, for a further press nip to be arranged in front of the first press nip, it being, for instance, provided with a double felt.

In another group of embodiments, either a transfer roll developed as suction-blow roll or an additional transport felt is provided for the transfer of the web from the first press to the second. Or else it is attempted, by special measures, to have the water removal felt of the first press serve at the same time as transport felt.

It is common to all embodiments of the invention that they can be operated without the expensive suction press rolls. However, if necessary, the invention can also be carried out with the use of a suction press roll.

Other features and advantages of the present invention will become apparent from the following description of the invention which refers to the accompanying drawings.

BRIEF DESCRIPTION OF THE DRAWINGS

FIGS. 10 and 11 are two partial longitudinal sections through different long-nip press rolls with respective inflatable press shells.

DETAILED DESCRIPTION OF THE DRAWINGS

Figure 1:
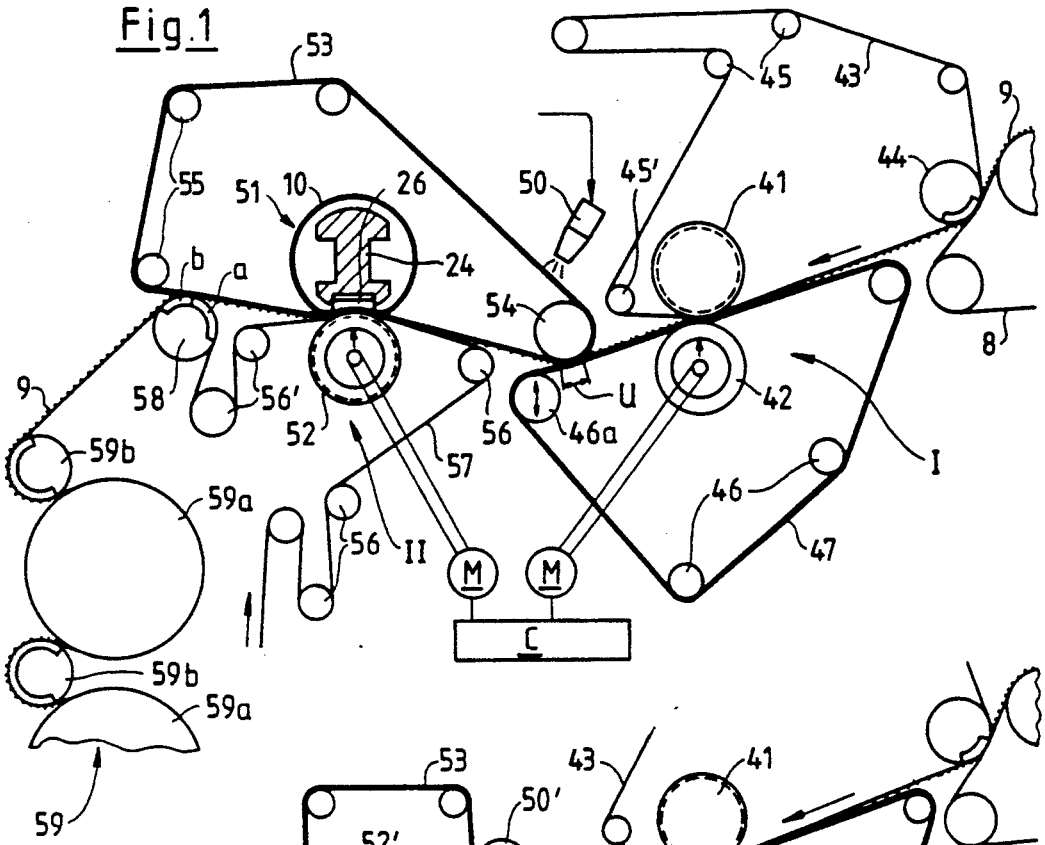
FIGS. 1, 1*a*, 2, 2*a*, 3, 3*a*, 3*b*, 4, 4*a*, 4*b*, 5, 6, 7, 7*a*, 8, 8*a* and 9 diagrammatically show various press-section configurations illustrating certain principles of the present invention.

Referring now to the drawings and particularly to FIG. 1, there is shown a press section of a paper machine which includes a first press I having a first pair of rolls 41, 42 and a second press II having a second pair of rolls 51, 52. Through the press nip formed by the first pair of rolls 41, 42 there travels a first felt belt 43 which removes the paper web from which the water is to be removed (represented by a dotted line 9) by means of a removal suction roll 44 from the endless wire 8 (only partly visible) of a wire section. The felt web 43 travels around the upper press roll 41, which has circumferential grooves or blind holes (as diagrammatically indicated by a dashed-line circle) and, furthermore, over the customary guide rolls 45. The symbolic showing of the lower press roll 42 indicates that this roll can be developed as a sag-adjustment roll. Around this press roll 42 and guide rolls 43 there travels a first endless elastic press belt 47 made, for instance, of an elastomeric plastic with reinforcement fibers incorporated therein, for instance in accordance with U.S. Pat. No. 4,552,620 or WO 88/08897. The guide roll 45' arranged directly behind the pair of rolls 41, 42 assures a rapid separation of the first felt belt 43 from the paper web 9 which travels, supported by the first press belt 47, in the direction towards the second press II. Instead of the lower press roll 42 shown in FIG. 1, a press shoe over which the press belt 47 is directly conducted may be employed.

While, therefore, the bottom side of the paper web 9 comes into contact with the first elastic press belt 47 in the first press I, a second top press belt 53 is provided in the second press II which comes into contact with the top side of the paper web 9 and which (in the example shown) travels around a so-called shoe press roll 51. The essential parts thereof are a stationary support body 24, a tubular elastic press shell 10 and a radially moveable press shoe 26. These parts are present in the shoe-press rolls of all embodiments. The support body 24, however, is only shown in FIGS. 1 and 1*a*.

The press shoe 26 presses the press shell 10 and the second press belt 53 against the lower press roll 52 which, in its turn, is developed as a sag adjustment roll but with a grooved shell. The paper web 9 is removed by the second press belt 53 by means of a removal roll 54 from the press belt 47 of the first press I. For this purpose, one of the guide rolls of the first press belt 47, namely the guide roll 46*a*, is so arranged that the first press belt 47 wraps somewhat around the removal roll 54. In other words, the two press belts 47 and 53 have a common travel path U on a part of the circumference of the removal roll 54; however, they separate from each other while still on the circumference of the removal roll 54. The guide roll 46*a* can be adjustable in a vertical direction (as indicated by the double-ended arrow) so that the two press belts 47, 43 diverge at an adjustable angle from each other behind the common travel path U.

A moistening device 50 (for instance a water spray pipe or steam nozzles) can be arranged in front of the removal roll 54 on the outside of the second press belt 53. By a slight moistening of the outer side of the press belt, a dependable removal of the web 9 from the first press belt 17 can be facilitated. It is frequently sufficient to provide moistening devices 50 only at the two edges of the press belt 53.

A second felt belt 57 passes around the lower press roll 52 of the second press II. Behind the pair of rolls 51 and 52, the second felt belt 57 is removed as rapidly as possible from the paper web 9 in order to avoid rewetting. At a certain distance behind the second pair of rolls 51, 52, the second felt belt 57 travels over a suction roll 58 in order to remove the paper web 9 from the second press belt 53 and bring it into the first dryer group 59 of a dryer section of which only two dryer cylinders 59*a* and two reversing rolls 59*b* are shown. The suction zone of the suction roll 58 can be divided into a first zone a, which serves for the conditioning and water removal of the second felt belt 57, and into a second zone b which serves for the removal of the paper web 9 from the press belt 53.

The press roll 42 of press I and the press roll 52 of press II are each driven by respective motors M whose speeds of rotation can be controlled by a drive control device C. For example, the operating speed of the second press II can be somewhat greater than that of the first press I (e.g., from 1% to 5% greater). Thus, the second press belt 53 travels somewhat faster than the first press belt 43. In this way, the transfer of the web from the first press belt to the second press belt can be facilitated. However, this method (establishing of a different speed) will generally only be used if other measures (for instance, tighter tensioning of the second press belt or wetting or cooling of the second press belt) do not provide the desired success.

Figure 1A:
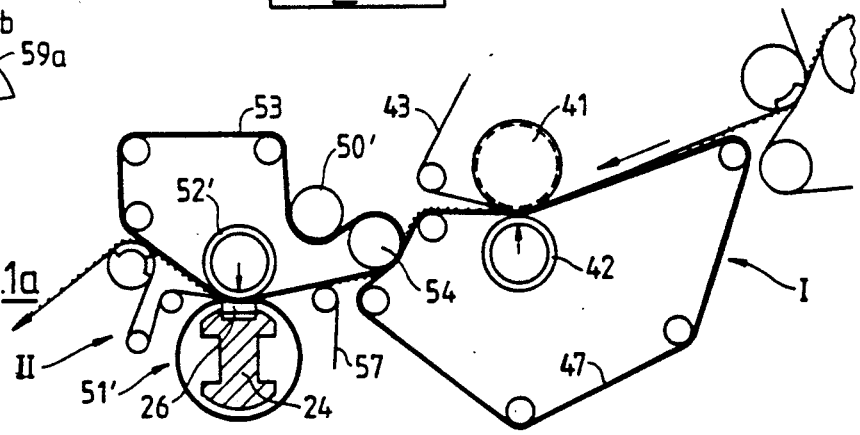

The arrangement in accordance with FIG. 1*a* differs from FIG. 1 essentially only by the fact that the two rolls 51 and 52 of the second press II are interchanged. In other words, the shoe press roll 51 now lies within the loop of the bottom, second felt belt 57 and the sag adjustment roll 52' (in this case with a smooth shell) lies within the loop of the upper press belt 53. In this way, it is possible, with the same roll dimensions, to employ a higher linear pressure in the second press II since now the pressing force of the shoe press roller 51 and the force of gravity now counteract each other on the roll jacket of the sag adjustment roll 52', i.e. they no longer add to each other as in the arrangement in accordance with FIG. 1. Instead of a moistening device (50 in FIG. 1), a cooling roll 50' over which the outer side of the second press belt 53 travels is now provided in FIG. 1a.

Figure 2:
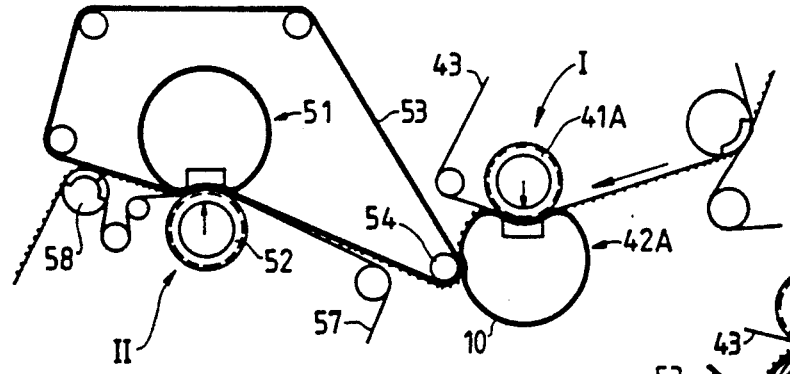

Essentially, FIG. 2 differs from FIG. 1 in that a shoe press roll 42A is employed as an elastic press element in the first press I. The shoe press roll 42A replaces the lower press roll 42, the guide rolls 46 and 46*a* and the elastic press belt 47 of FIG. 1. Its press shell 10, therefore, comes into direct contact with the web 9, in contradistinction to the press shells 10 of the shoe press rolls 51, 51' of FIGS. 1 and 1*a*. As will be explained further below with reference to FIG. 10, the press shell 10 can be inflated in the case of all shoe press rolls, for instance 51 in FIG. 1 and 42A in FIG. 2. In this way, the press shell 10 can rest within the region of the removal roll 54 for a distance against the press belt 53 of the second press II and, together with the latter, again form a short common path of travel. The upper press roll 41A is now in the form of a sag adjustment roll with a grooved press shell.

Figure 2A:
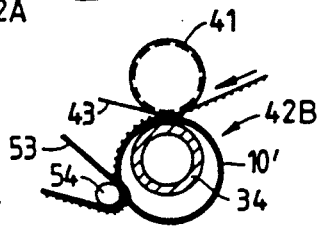

In accordance with FIG. 2*a*, the lower press roll 42B of the first press I is now in the form of a so-called loose-shell press roll. The details thereof are described further below with reference to FIG. 11. Again, an inflatable press shell 10' is provided, which now, however, is pressed against the upper press roll 41 by means of a rotatable roll body 34 (instead of a press shoe 26). Another possible variant (not shown) is one in which (referring to FIG. 2) the shoe press roll 42A is replaced by a hard press roll with a smooth shell surface, for instance a stone roll, from which the elastic press element of the second press II, for instance, press belt 53, removes the web by direct contact with the stone roll.

Figure 3:
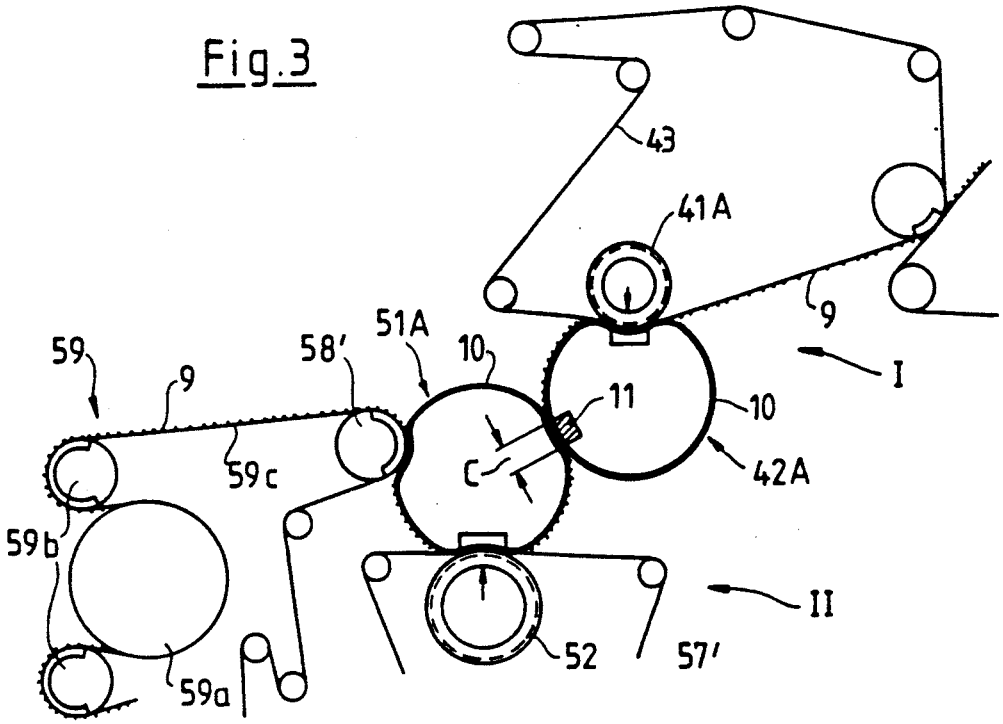

In the embodiment shown in FIG. 3, the same parts are present in the first press I as in FIG. 2, in particular an upper press roll 41A and a lower shoe press roll 42A. The second press II is now formed of an upper shoe press roll 51A and a lower press roll 52 around which a felt belt 57 travels. The two press rolls 42*a* and 51*a* are again in the form of sag adjustment rolls with grooved shells. The two shoe press rolls 42A and 51A again each have a tubular inflatable press shell 10. Another difference between FIGS. 3 and 1 is that the first dryer group 59*a* has a separate support belt (for instance, dryer wire 59*c*) which removes the paper web 9 by means of a removal suction roll 58' from the shoe press roll 51A and conducts it over the dryer cylinder 59*a* and reversing rolls 59*b*. In this embodiment also it is important that the two press shells 10 are closed at both ends; this is important not only in order to prevent the emergence of lubricating oil, but also so that the press shells are inflatable. In this way, they can again form a short common path of travel c which serves for the transfer of the paper web 9 from the first press to the second press. It may be advisable to support one of the two press shells 10 by means of a stationary ledge 11 at the place of transfer.

Figure 3A:
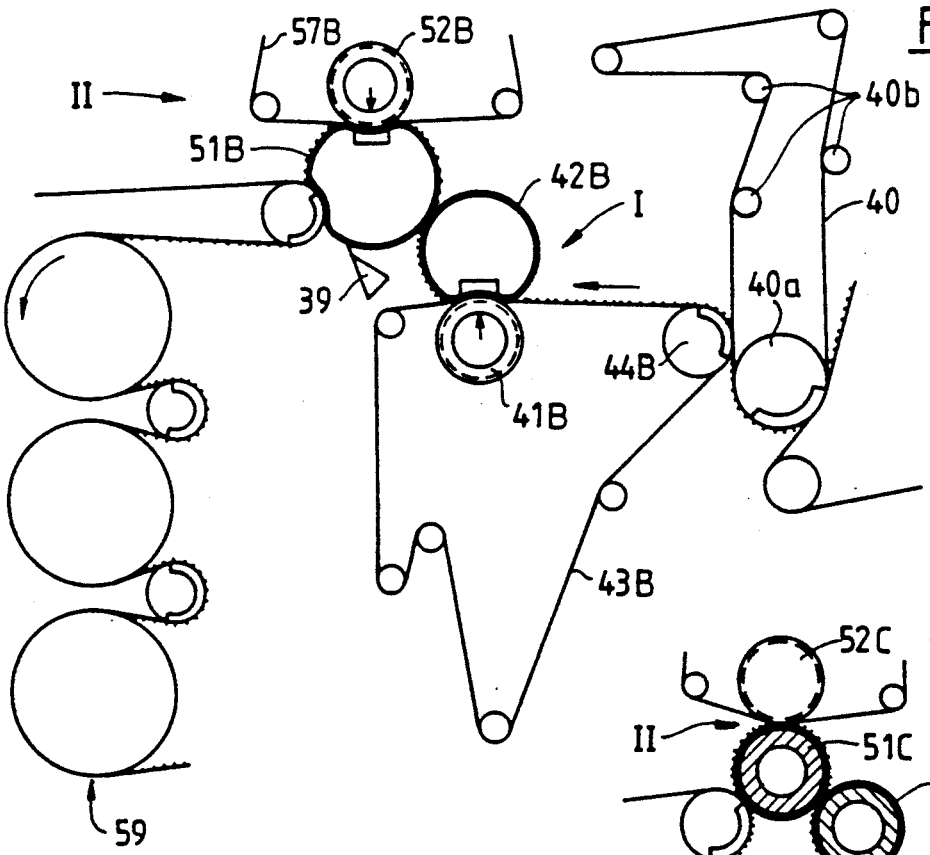
Figure 3B:
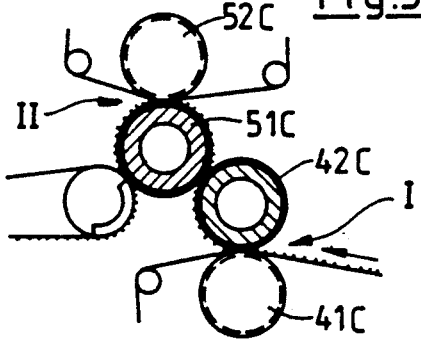

If the two presses I and II in FIG. 3 are placed upside down, one then obtains a configuration in accordance with FIG. 3*a* having the press rolls 41B, 42B, 51B and 52B. The advantage of this configuration is that the relatively large amount of water obtained in the first press I on the lower press roll 41B can travel downward with the rotating roller shell. Furthermore, a relatively high pressing force can again be applied in the second press II, as has been explained above with reference to FIG. 1*a*. To be sure, there is furthermore necessary an additional removal felt belt 40 with an additional removal suction roll 40*a* and with the corresponding guide rolls 40*b*. The felt belt 43B of the first press I takes the web 9 over from the removal felt belt 40 by means of the removal section roll 44B. On the lower, free part of the circumference of the second shoe press roll 51B a scraper 39 is provided for the removal of paper residue. The press section configuration shown in FIG. 3*a* could also be realized with loose shell press rolls (in accordance with FIG. 11) instead of the shoe press rolls. Another possibility is to replace the shoe press rolls according to FIG. 3*b* by normal press rolls 42C and 51C which have a covering which is soft and elastic but which is firmly attached to roll body. The mating rolls thereof are designated 42C and 51C respectively. In this case also, the special feature of the arrangement resides in the fact that the two elastic press elements, namely the elastic coverings of the rolls 42C, 51C, come into contact with each other in order to transfer the paper web from the first press I to the second press II.

Figure 4:
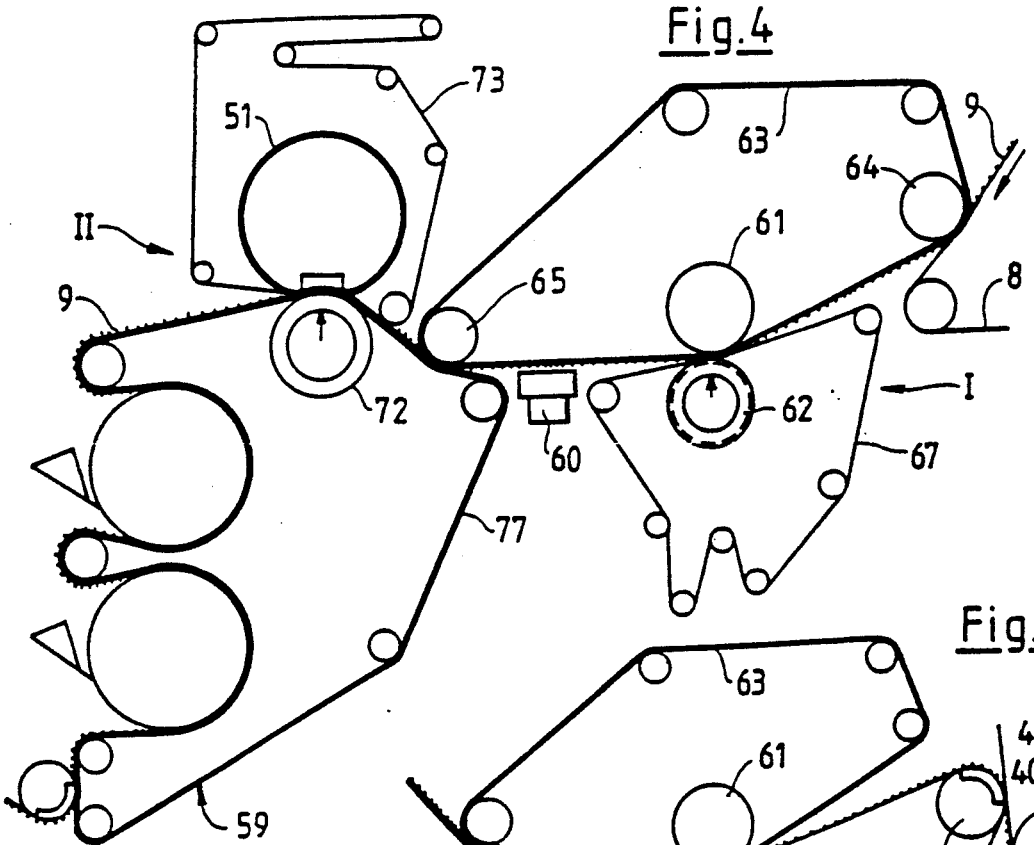
Figure 4A:
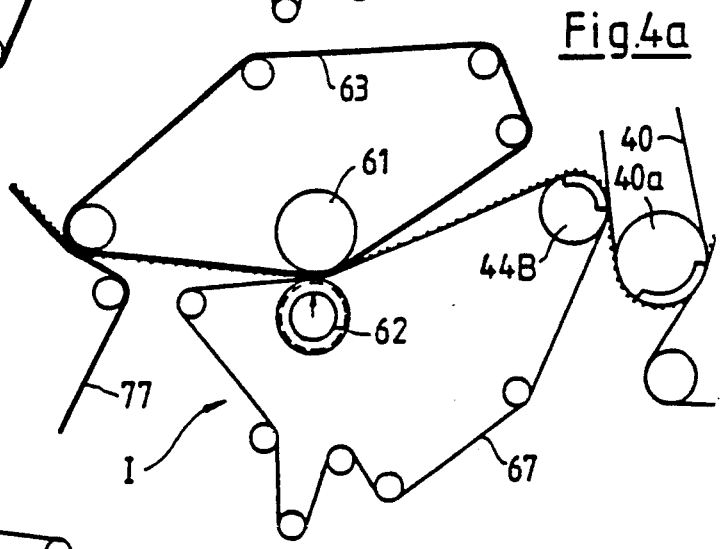

In the embodiment shown in FIG. 4, the arrangement of the press rolls 61, 62 and 51, 72 agrees substantially with the arrangement of the press rolls 41, 42 and 51, 52 of FIG. 1. However, in both presses I and II the felt belts and the press belts are interchanged. The upper first press belt 63 now serves for the removal of the paper web 9 from the wire belt 8. If the press belt 63 is completely air impervious, then the removal roll 64 is developed as a normal roll without suction means. However, it is also conceivable to use a first press belt 63 which has slight air perviousness and nevertheless does not take up any water in the first press nip since its outer side which is contacted by the paper web 9 is water repellent. In this case, the removal roll 64 can, as previously, be in the form of a suction roll. The lower press roll 62 around which the first felt belt 67 travels is again in the form of a sag adjustment roll but it now has a grooved shell. In the second press II, a second felt belt 73 travels around the upper shoe press roll 51. A second elastic press belt 77 travels around the bottom sag adjustment roll 72 to remove the paper web 9 from the first press belt 63 (on the guide roll 65) and conduct it through the second press nip as well as over the dryer cylinder and reversal rolls of the first dryer group 59. For this, it is advantageous (but not absolutely necessary) for the second press belt 77 to be air-pervious so that evaporation can take place on the dryer cylinders. In front of the guide roll 65, a heating device 60 which heats the web 9 can be provided on the outside of the first press belt 63 in order to facilitate the transfer of the web to the second press belt and in order to increase the water removal of the second press II. Such an increase in performance can also be obtained by heating the press belt 77 (FIG. 4) or the felt belt 57 (FIG. 1) on the dryer cylinders. The configuration in accordance with FIG. 4 can be modified, as shown in FIG. 4*a*, so that an additional removal felt 40 with an additional removal suction roll 40*a* and the bottom felt belt 67 of the first press I (together with another removal suction roll 44B) serve to transfer the paper web 9 from the wire belt 8 into the first press I.

Figure 4B:
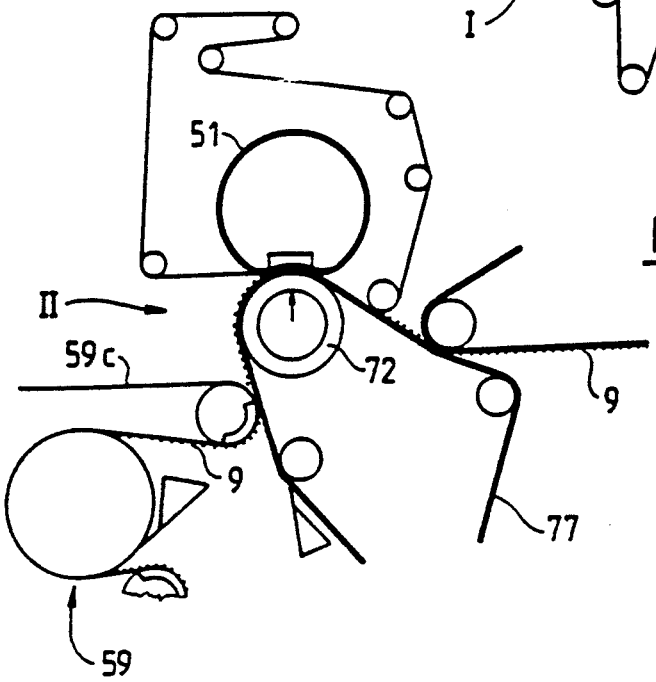

Another possible modification of FIG. 4 is shown in FIG. 4*b*. In this case, the bottom elastic press belt 77 travels only over the lower press roll 72 of the second press II and over guide rolls. The first dryer group 59, on the other hand, has its own support belt 59*c* which removes the paper web 9 from the press belt 77.

Figure 5:
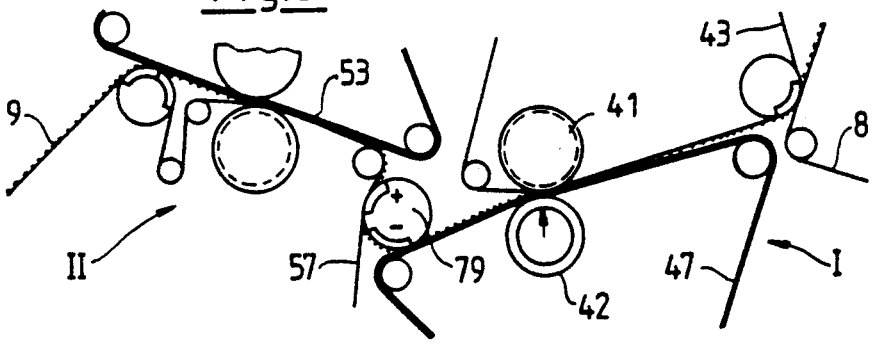

FIG. 5 shows another possible modification of the embodiment according to FIG. 1. Now, a transfer roll 79 is provided for the transfer of the paper web 9 from the first press I to the second press II. The transfer roll 79 removes the paper web 9 from the press belt 47 by means of a suction zone (indicated by a minus sign). In the region of a following blow zone (indicated by a plus sign), the felt belt 57 of the second press II travels a distance over the roll 79 and thereby picks up the paper web.

Figure 6:
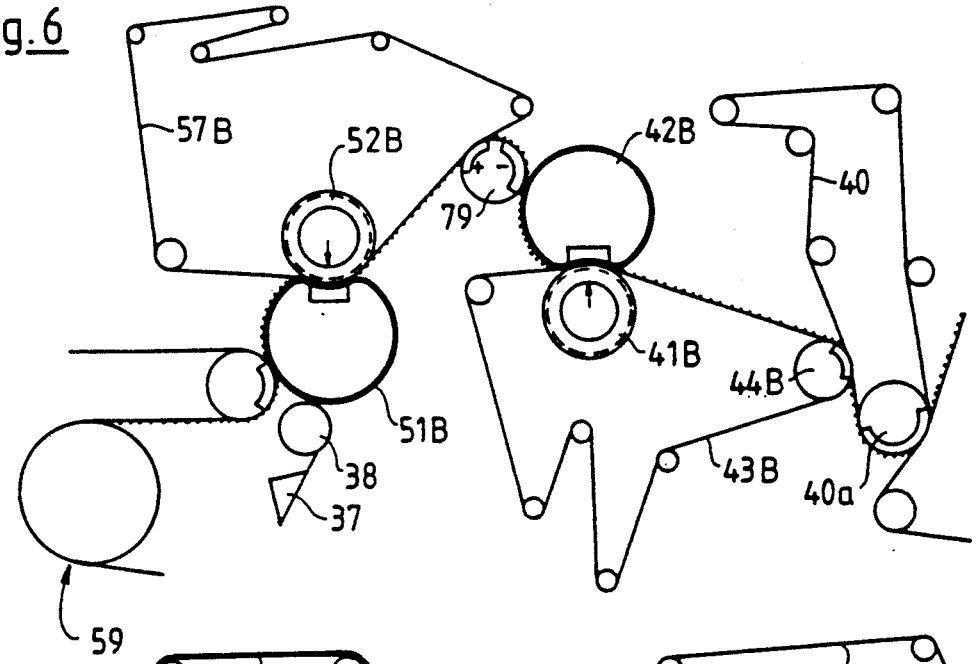

The embodiment in accordance with FIG. 6 corresponds essentially to the configuration in accordance with FIG. 3*a*. Except, in this case (similar to FIG. 5), a transfer roll 79 is provided which transfers the paper web 9 from the press shell of the first press I to the felt belt 57B of the second press II. Instead of the scraper (39, FIG. 3*a*) a residue removal roll 38 having a scraper 37 is provided.

Figure 7:
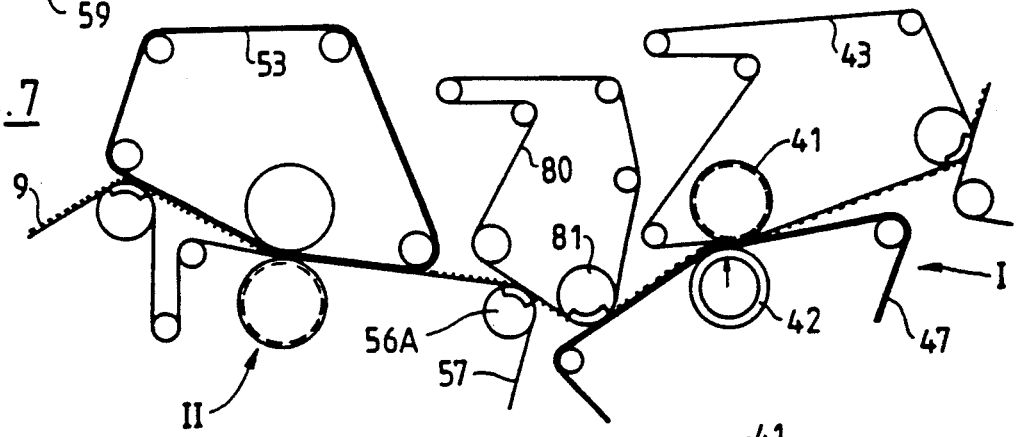
Figure 7A:
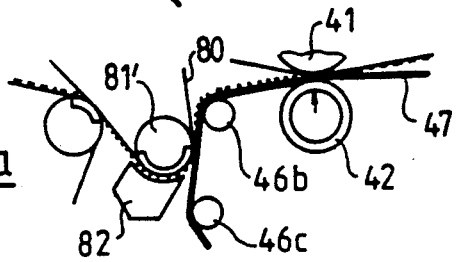

Instead of a transfer roll 79 an additional transport felt 80 with an additional removal suction roll 81 can also be provided. This is shown in the example of FIG. 7, which otherwise corresponds essentially to FIG. 1. The lower felt belt 57 of the second press II removes the paper web 9 by means of an additional removal suction roll 56A from the transport felt 80 and brings it to the second press II. This embodiment can be further modified in accordance with FIG. 7*a*. There is shown therein a steam blow box 82 which, in an enlarged wrapping zone of the removal suction roll 81', heats the paper web 9 in known manner. For this purpose, the bottom elastic press belt 47 travels behind the pair of rolls 41, 42 over two guide rolls 46*b* and 46*c* which are approximately vertically one above the other. The paper web 9 is removed between these two guide rolls from the press belt 47 by the transport belt 80.

Figure 8:
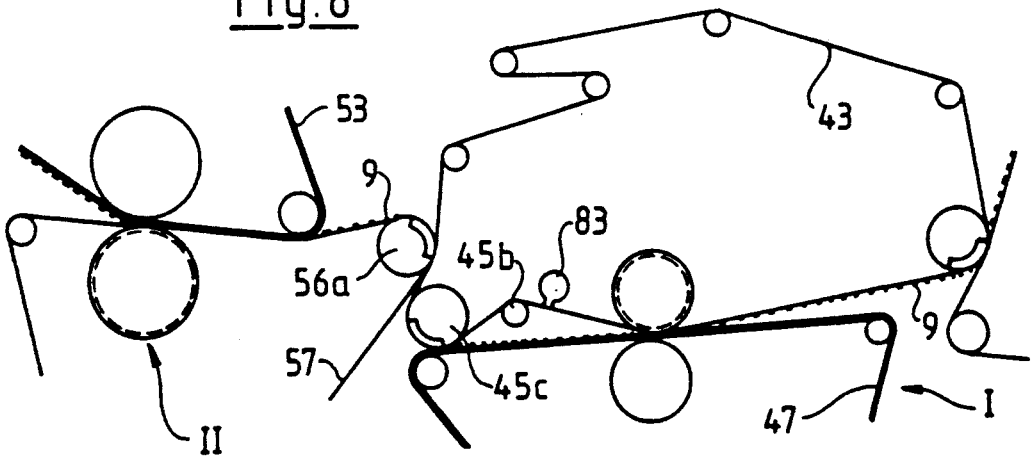
Figure 8A:
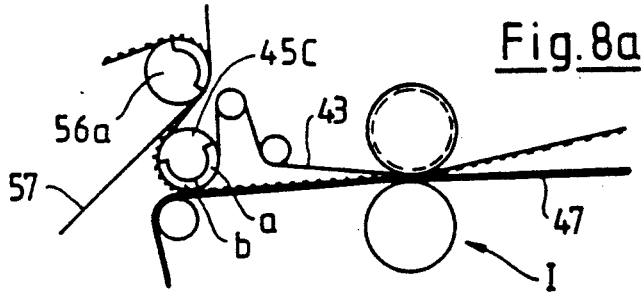

Another method for transferring the paper web from the first press to the second press is shown in FIG. 8. As in FIG. 1, the upper felt belt 43 of the first press I is separated from the paper web 9 directly behind the press nip. The felt belt is now conditioned by a felt suction device 83 and fed via a guide roll 45*b* to a removal suction roll 45*c* which again brings the felt belt 43 into contact with the paper web and removes it from the bottom press belt 47. Thereupon the bottom felt belt 57 of the second press picks up the paper web 9 by means of a removal suction roll 56*a* and conducts it to the second press II. FIG. 8*a* differs from FIG. 8 only by the fact that the removal suction roll 45C has a large wrapping zone and accordingly a larger suction box. In this way, this removal suction roll can serve at the same time for the conditioning of the felt belt 43. The suction zone can, for this purpose (in the same way as in the case of the removal suction roll 58 of FIG. 1) be subdivided into a first suction zone a and a second suction zone b.

Figure 9:
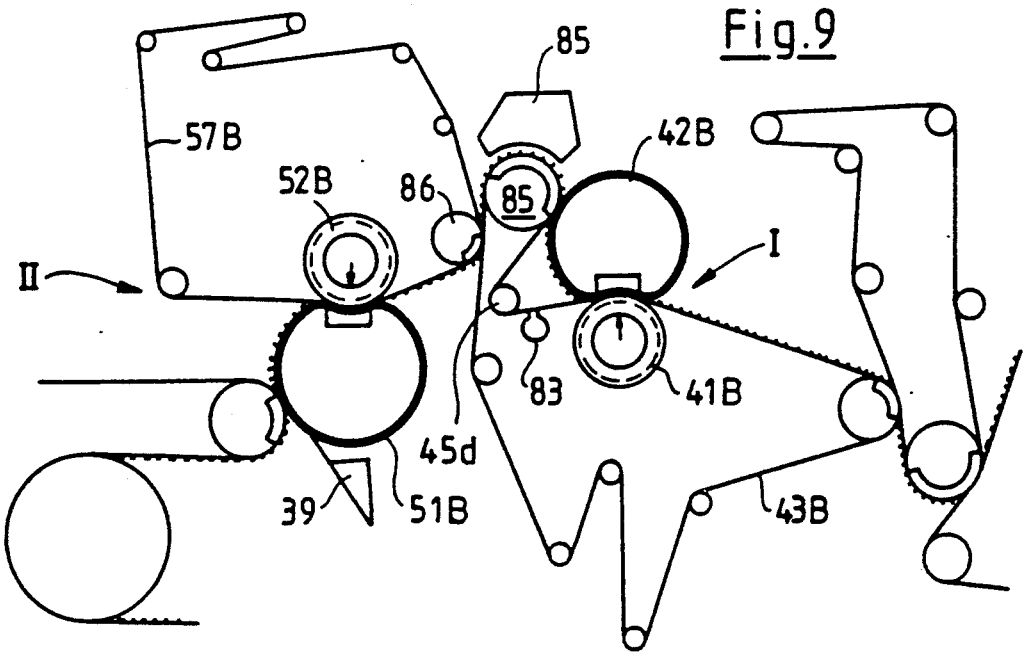

FIG. 9, finally, shows another possible modification of the embodiment in accordance with FIG. 3*a*. Similar to what is shown in FIG. 8, the felt belt 43B of the first press I is conditioned directly behind the press nip by means of a felt suction device 83 and then returned over a guide roll 45*d* to the press shell of the shoe press roll 42B. There the felt belt 43B again picks up the paper web, namely by means of a removal suction roller 84. The zone of wrap thereof is more than 180° so that here again a steam blow box 85 can be provided. The felt belt 57B of the second press II thereupon takes up the paper web by means of another removal suction roll 86 and conducts it into the press nip of the second press II.

Each of the shoe press rolls (for instance, 51' in FIG. 1*a*) has, as shown in FIG. 10, a non-rotating support body 24 which is supported at its two ends (only one of which is visible) by in each case a journal pin 24*a* in a bearing bracket 25. On its outside, the support body 24 has a recess 24*b* within which there is arranged a press shoe 26, the length of which corresponds approximately to the width of the paper web 9. An endless tubular press shell 10 is provided around the support body 24 and the press shoe 6. By the action of a pressure fluid, the press shoe 26 can press the press shell 10 against a mating roll 52.

On each end of the roll, a bearing ring 14 is displaceable axially on the journal pin 24*a*, but not rotatable. A shell support disk 12 is supported for rotation on the bearing ring 14 by means of an anti-friction bearing 13. On the outer end side of said shell support disk 12 the radially inwardly shaped edged zone of the press shell 10 is fastened by means of a clamping flange 15 and screws 16.

In order to seal off the inside of the press roll (defined by press shell 10 and the shell support disk 12) from the outside, the press shell 10 consists essentially of a liquid-tight plastic, for instance, polyurethane; it is preferably reinforced with a fabric or with threads wrapped therein. A sealing surface is designated B and an O-sealing ring is designated 23. On the outside of the anti-friction bearing 13, there is provided a shaft sealing ring 19 which rests in a housing ring 20 fastened to the shell support disk 12.

FIG. 11 shows a so-called loose-shell press roll which has a loose press shell 10'. As distinguished from FIG. 10, the support body is now in the form of a roll body 34 which is rotateably mounted and is, therefore, cylindrical. Roll body 34 can, if necessary, be coupled with a drive by means of a pin 34*a*. The basic shape of the press shell 10' is the same as that of the press shell 10 of FIG. 10. The end liquid- tight closure of the inner space defined by the press shell 10 is developed as follows. A bearing ring 31 is formed on the roll body 34. On it there is mounted (with anti-friction bearing 13' and sealing ring 32) an annular shell supporting element 12' (concentric to the roll body 34). The press shell 10 is fastened to the outer end surface of the shell support element 12' by means of clamping ring 15' and screws 16'.

At the top of FIG. 11, there can be noted a small piece of a mating roll 41 which forms a press nip with the press roll. Outside the press nip, there is a distance d between press shell 10' and roll body 34 since the inside diameter of the press shell 10' is greater than the outside diameter of the roll body 34.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A press section of a paper machine for the removal of water from a web, which comprises:

a first press nip;

a second press nip;

a first endless felt belt for absorbing water from a web arranged to travel through the first press nip and a second endless felt belt for absorbing water from the web arranged to travel through the second press nip;

a first endless elastic press element disposed in the first press nip structured and arranged to be in contact with one side of the web;

a second endless elastic press element disposed in the second press nip structured and arranged to be in contact with the other side of the web, the first and second endless elastic press elements having a water absorption capacity less than that of the first and second felt belts;

the first endless felt belt and the first endless elastic press element forming a first transport means for transporting the web through the first press nip and the second endless felt belt and the second endless elastic press element forming a transport mechanism for transporting the web through the second press nip, the web being in continuous contact with one or the other of the first and second transport means during transport of the web through the first and second press nips;

the two endless elastic press elements coming into contact with each other along a common travel path for the transfer of the web therebetween;

the web-contacting outer side of at least one of the two elastic press elements being water impervious and at least one of the elastic press elements being a liquid-tight press shell;

separate drive means for each of the first and second elastic press elements; and a drive control device for varying the speed between the two elastic press elements.

2. A press section according to claim 1, in which the drive control device is structured and arranged so that the second elastic press element can be driven at a higher speed than the first elastic press element.

3. A press section according to claim 2, wherein the drive control device is structured and arranged so that the difference in speed between the two elastic press elements is between 1% and 5%.

4. A press section of a paper machine for the removal of water from a web, which comprises:

a first press nip;

a second press nip;

a first endless felt belt for absorbing water from a web arranged to travel through the first press nip and a second endless felt belt for absorbing water from the web arranged to travel through the second press nip;

a first endless elastic press element disposed in the first press nip structured and arranged to be in contact with one side of the web;

a second endless elastic press element disposed in the second press nip structured and arranged to be in contact with the other side of the web, the first and second endless elastic press elements having a water absorption capacity less than that of the first and second felt belts;

the first endless felt belt and the first endless elastic press element forming a first transport means for transporting the web through the first press nip and the second endless felt belt and the second endless elastic press element forming a transport mechanism for transporting the web through the second press nip, the web being in continuous contact with one or the other of the first and second transport means during transport of the web through the first and second press nips;

the second elastic press element having fine pores which permit the passage of gases;

dryer cylinders; and guide rolls, the second elastic press element travelling together with the web alternately over the dryer cylinders and the guide rolls so that the web comes into contact with the dryer cylinders.

5. A press section of a paper machine for the removal of water from a web, which comprises:

a first press nip;

a second press nip;

a first endless felt belt for absorbing water from a web arranged to travel through the first press nip and a second endless felt belt for absorbing water the web arranged to travel through the second press nip;

a first endless elastic press element disposed in the first press nip structured and arranged to be in contact with one side of the web;

a second endless elastic press element disposed in the second press nip structured and arranged to be in contact with the other side of the web, the first and second endless elastic press elements having a water absorption capacity less than that of the first and second felt belts;

the first endless felt belt and the first endless elastic press element forming a first transport means for transporting the web through the first press nip and the second endless felt belt nad the second endless elastic press element forming a transport mechanism for transporting the web through the second press nip, the web being in continuous contact with the second press nip, the web being in continuous contact with one or the other of the first and second transport means during transport of the web through the first and second press nips;

the two endless elastic press elements coming into contact with each other along a common travel path for the transfer of the web therebetween;

the web-contacting outer side of at least one of the two elastic press elements being water impervious and at least one of the elastic press elements being a liquid-tight press shell;

a removal roll and a guide roll, both located between the first and second press nips;

means for adjusting the guide roll in a vertical direction, the common travel path of the two elastic press elements being on the circumference of the removal roll and the two press elements separating from each other on the circumference of the removal roll, the angle formed between the two elastic press elements behind the place of separation being variable by adjusting of the guide roll.

6. A press section of a paper machine for the removal of water from a web, which comprises:

a first press nip;

a second press nip;

a first endless felt belt for absorbing water from a web arranged to travel through the first press nip and a second endless felt belt for absorbing water from the web arranged to travel through the second press nip;

a first endless elastic press element disposed in the first press nip structured and arranged to be in contact with one side of the web;

a second endless elastic press element disposed in the second press nip structured and arranged to be in contact with the other side of the web, the first and second endless elastic press elements having a water absorption capacity less than that of the first and second felt belts;

the first endless felt belt and the first endless elastic press element forming a first transport means for transporting the web through the first press nip and the second endless felt belt and the second endless elastic press element forming a transport mechanism for transporting the web through the second press nip, the web being in continuous contact with one or the other of the first and second transport means during transport of the web through the first and second press nips;

separate drive means for each of the first and second elastic press elements; and a drive control device for varying the speed between the two elastic press elements.

7. A press section according to claim 6, wherein the web-contacting outer side of at least one of the two elastic press elements is water impervious.

8. A press section according to claim 7, wherein the web-contacting outer side of the second elastic press element has a greater hardness than that of the first elastic press element.

9. A press section according to claim 6, wherein at least one of the two elastic press elements is a liquid-tight press shell closed at both ends.

10. A press section according to claim 6, wherein the two endless elastic press elements come into contact with each other along a common travel path for the transfer of the web therebetween.

11. A press section according to claim 6, characterized by the fact that it is free of suction press rolls.

12. A press section of a paper machine for the removal of water from a web, which comprises:

a first press nip;

a second press nip;

a first endless felt belt for absorbing water from a web arranged to travel through the first press nip and a second endless felt belt for absorbing water from the web arranged to travel through the second press nip;

a first endless elastic press element disposed in the first press nip structured and arranged to be in contact with one side of the web;

a second endless elastic press element disposed in the second press nip structured and arranged to be in contact with the other side of the web, the first and second endless elastic press elements having a water absorption capacity less than that of the first and second felt belts;

the first endless felt belt and the first endless elastic press element forming a first transport means for transporting the web through the first press nip and the second endless felt belt and the second endless elastic press element forming a transport mechanism for transporting the web through the second press nip, the web being in continuous contact with one or the other of the first and second transport means during transport of the web through the first and second press nips; and a third felt belt and a removal suction roll structured and arranged for the transfer of the web from the first endless elastic press element to the second endless felt belt.

13. A press section of a paper machine for the removal of water from a web, which comprises:

a first press nip;

a second press nip;

a first endless felt belt for absorbing water from a web arranged to travel through the first press nip and a second endless felt belt for absorbing water from the web arranged to travel through the second press nip;

a first endless elastic press element disposed in the first press nip structured and arranged to ne in contact with one side of the web;

a second endless elastic press element disposed in the second press nip structured and arranged to be in contact with the other side of the web, the first and second endless elastic press elements having a water absorption capacity less than that of the first and second felt belts;

the first endless felt belt and the first endless elastic press element forming a first transport means for transporting the web through the first press nip and the second endless felt belt and the second endless elastic press element forming a transport mechanism for transporting the web through the second press nip, the web being in continuous contact with one or the other of the first and second transport means during transport of the web through the first and second press nips;

an auxiliary guide roll;

a removal suction roll, the auxiliary guide roll separating the first endless felt belt from the web directly behind the first press nip and guiding the first felt to the removal suction roll said removal suction roll being structured and arranged to remove the web from the first elastic press element.

14. A press section according to claim 13, wherein, the removal suction roll has a pre-suction zone to condition the first felt.

15. A press section according to claim 13, further including a felt suction device arranged for conditioning the first endless felt belt directly behind the first press nip.

* * * * *